United States Patent [19]

Kent et al.

[11] Patent Number: 5,031,525

[45] Date of Patent: Jul. 16, 1991

[54] EMBOSSING PLATE AND METHOD FOR USING

[75] Inventors: Raymond C. Kent; Charles Haines, Jr., both of Lancaster, Pa.

[73] Assignee: Armstrong World Industries, Inc., Lancaster, Pa.

[21] Appl. No.: 455,234

[22] Filed: Dec. 22, 1989

[51] Int. Cl.[5] ..... B31F 1/07
[52] U.S. Cl. ..... 101/32; 8/471
[58] Field of Search ..... 101/32, 34, 470; 8/471

[56] References Cited

U.S. PATENT DOCUMENTS

| | | | |
|---|---|---|---|
| 4,138,945 | 2/1979 | Rejto | 101/32 |
| 4,174,250 | 11/1979 | Durand | 101/470 |
| 4,238,190 | 12/1980 | Rejto | 8/471 |
| 4,541,340 | 9/1985 | Peart et al. | 101/32 |
| 4,789,328 | 12/1988 | Knoll | 425/394 |

*Primary Examiner*—Edgar S. Burr
*Assistant Examiner*—Ren Yan

[57] ABSTRACT

An embossing plate having a geometric shape or decorative pattern projecting on its face is used with a printed sublimation transfer paper to impress the pattern in the fabric surface of a fabric-covered substrate.

4 Claims, 1 Drawing Sheet

EMBOSSING PLATE AND METHOD FOR USING

This invention relates to a unique one-step process for printing fabric-covered substrates and certain painted panels for use in wall coverings or ceiling panels. This invention also relates to a novel embossing plate for use in the process. In addition, this invention describes a fabric-covered substrate or ceiling tile which has been impressed with a geometric shape or decorative pattern.

BACKGROUND

1. Field of the Invention

Printing of wall surfaces and ceiling panels is well known. Obtaining a variety of effects involving several colors as well as a plethora of geometric shapes or decorative patterns is not new. The idea of embossing to obtain the geometrical shapes or decorative patterns followed by a complex process of using differently colored ink plates to provide coating of the valley areas of the embossed product or painstakingly decorating the valley areas of the embossed product has not achieved any significant commercial success. Furthermore, these processes provide non-precise coating of the valleys or, in the case of decorating, provide a process that is difficult to control and, with materials such as woven or non-woven fabrics, is almost impossible to perform.

2. Prior Art

Valley printing, as stated in "Plastics Machinery & Equipment," November 1973, is the application of inks to the tips of an embossing roll to produce three-dimensional fabrics with a wide range of colorful visual effects. The equipment used involves an embossing section, a metering system and a heat source to make the fabric receptive to the embossing. Ink is metered to the embossing roll where it is deposited on the tips of the roll. As the roll comes in contact with the fabric, the ink is delivered to the valleys on the embossed fabric. The ability to meter ink is the heart of the valley printer. If there is too much ink, the valley becomes "flooded"; if there is too little, the pattern appears "washed out". If the valley printer involves three or more colors, the metering problems are multiplied.

U.S. Pat. Nos. 3,399,101, 3,850,095, and 4,135,024 are representative of the complicated methods and equipment used to accomplish valley printing. U.S. Pat. No. 3,399,101 utilizes a unique construction of plastic sheeting wherein the embossing on a concealed surface is printed or decorated but remains visible through the sheet. U.S. Pat. No. 3,850,095 employs a deeply engraved embossing roll and hot melt inks to emboss a fiber carpet while color decorating in the valley areas and sealing the embossed areas in place. U.S. Pat. No. 4,135,024 provides a method of simultaneously strengthening and decorating a low-integrity dry-formed non-woven fibrous web to impart a valley print decorative effect.

Sublimation transfer printing, as described starting on page 240 of "An Introduction to Textile Printing", Clarke, 4th Edition, 1974, is a process pioneered in 1969, often described as "dry dyeing". The process involves the use of dyes, usually disperse dyes which will sublime at temperatures below those which will damage the fabric with which the dyes are in contact. The fabric is one for which the disperse dyes have an affinity. Specifically, all that is required is a supply of suitably printed sublimation transfer paper, a supply of fabric and a heat transfer press. The paper, with its printed surface in contact with the fabric, is placed between the surfaces of the heat transfer press. The press head, at about 400° F. for polyester fabric, is lowered and held for a sufficient time to transfer the dye to the surface of the fabric.

SUMMARY OF THE INVENTION

The object of this invention is to get the effect of valley printing on a fabric-covered substrate with greater precision (no flooding or "washed-out" effects) and less effort and equipment than involved in the prior known valley printing processes.

The objects are accomplished by using a selectively insulated embossing plate having a geometric shape or decorative pattern, usually three-dimensional projecting from its base, with no insulation covering the projecting areas of the plate, a suitably printed sublimation transfer paper and a fabric—, preferably polyester, covered substrate. By heating and pressing the embossing plate onto the transfer paper with the paper's printed surface in contact with the fabric of the fabric-covered substrate, the projecting uninsulated areas, i.e., the geometric design or decorative pattern on the plate compresses (or imprints) the fabric, while at the same time, causes the disperse dyes to sublime at the corresponding areas of the paper to provide the fabric with an embossed surface having the design and the color or colors of the transfer paper in exact registration with the embossed image and the printing from the surface of the transfer paper. The process of this invention will also apply to a polymeric film-covered substrate such as wood fiber or the like used as the substrate and a latex, acrylic polymer or other polymeric paint used to form the film.

The geometric shape or decorative pattern may take the form of an animal, i.e., teddy bear, baby chicken, etc. to provide a ceiling or wall tile suitable for a child's room. In general, the pattern may take the form of any ornamental, pictorial, or decorative pattern limited only by the creative imagination of the designer.

DESCRIPTION OF THE INVENTION

Figure 1:
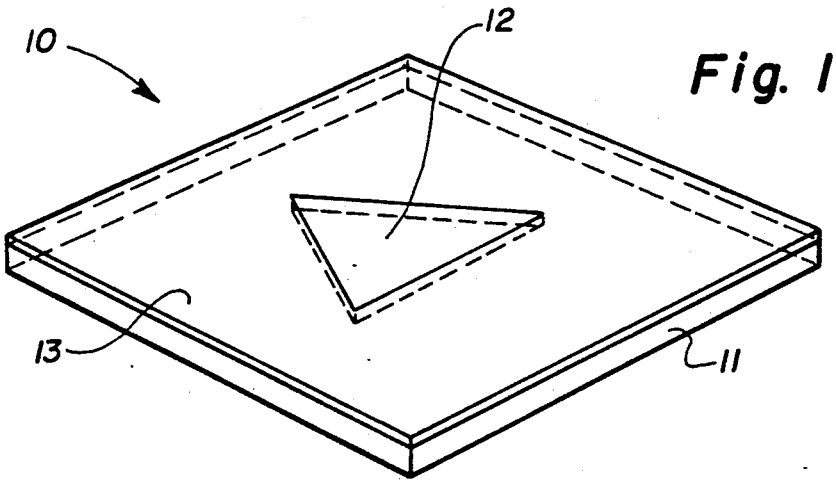
FIG. 1 is a representation, in perspective, of the embossing plate used in the invention.

Referring particularly to the drawings, FIG. 1 depicts the novel embossing plate 10 composed of a flat, usually metal surface 11 and a projecting design 12 integral with the base of the plate 10. The plate 10, except for the projection 12, is covered with an insulating layer 13. The insulation may be fiberglass or other insulating material. The projecting design from plate 10 may be such as to provide, along with a short dwell time, a sufficient volume of air for the short period between plate 10 and the paper 14 (shown in FIG. 2) to provide adequate insulation without the use of insulating material attached to the base portion 11 of plate 10.

Figure 2:
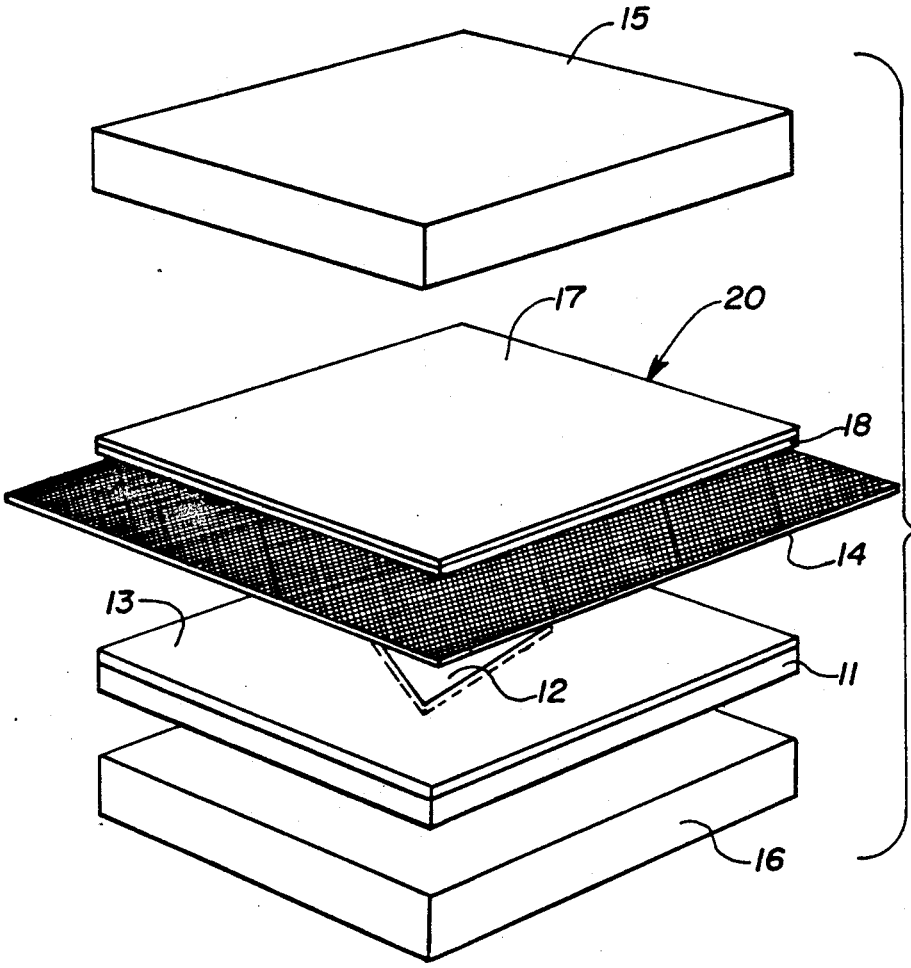
FIG. 2 is an exploded view of the elements used in the process of the invention.
Figure 3:
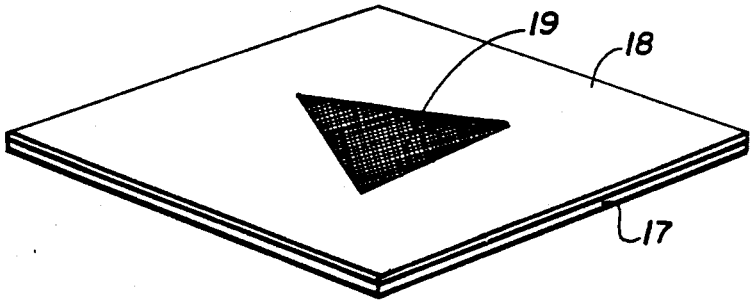
FIG. 3 is a representation of the product produced by the process of the invention.

In FIG. 2, two platens 15 and 16 are shown to represent the heating press. It is also possible to attach the embossing plate 10 to platen 15 or to an appropriate heat source to serve as the top platen of the press. In operation, the fabric-covered substrate 20 is placed under the surface 15 (or in a continuous process, the fabric-covered substrate 20 is passed under the surface 15). The special transfer paper 14 is placed with its printed surface in contact with the fabric 18 (or, in a continuous process passed in contact with the fabric) of the fabric-covered substrate 20.

By lowering the heated embossing plate 10 at a temperature of about 400° F. for a dwell time of about 15 seconds, the image 19 of the projection 12 of the embossing plate 10 with the design and colors of the transfer paper 14 are impressed in the fabric 18 of the fabric-covered substrate 17.

Although the invention has been demonstrated in a "batch process" in which the embossing plate, the transfer plate and the fabric-covered structure are placed between the plates of the press to make a single tile or panel, the process of the invention can easily be adapted to operate in a continuous manner. Such a continuous process would operate similar to a stamping process in which the fabric-covered structure and the transfer paper are passed from continuous rolls of the materials between the press plates; and the press plates would be brought together periodically while the flow of materials would be halted for similar periods to provide a series of tiles or panels of the invention.

What is claimed is:

1. A process for imprinting a geometric shape or decorative pattern with a plain or multi-color design on a fabric-covered substrate which comprises the following steps: (1) placing the fabric-covered substrate between two plates, one plate being or having attached thereto an embossing plate having a geometric shape or decorative pattern on the face of said plate and projecting from its surface and the second plate providing a supporting surface for the substrate of said fabric-covered substrate; (2) subsequently placing a sublimation transfer paper in contact with said embossing plate and between the face of said embossing plate and the fabric on said fabric-covered substrate, said paper having imprinted on the surface facing said fabric a plain or multicolor design composed of at least one sublimable disperse dye; (3) heating said embossing plate to a temperature sufficient to cause said disperse dye to sublime; and (4) simultaneously with or after step 3 bringing said two plates together at a sufficient pressure and for a sufficient time to transmit the sublimed dye in the geometric shape or decorative pattern on the face of the embossing plate and in the plain or multi-color design of the transfer plate onto the fabric-covered substrate such that said design is confined to the geometric shape or decorative pattern in the fabric on the fabric-covered substrate, the pressure being maintained while said disperse dye on said transfer paper is subliming.

2. A process as in claim 1 wherein the face of the embossing plate is covered with an insulating layer in the areas not containing any portion of the geometric shape or decorative pattern projections.

3. A process as in claim 1 wherein said fabric of the fabric-covered substrate is a polyester fabric.

4. A process as in claim 3 wherein said embossing plate is heated to about 400° F.

* * * * *

UNITED STATES PATENT AND TRADEMARK OFFICE

CERTIFICATE OF CORRECTION

PATENT NO. : 5,031,525

DATED : July 16, 1991

INVENTOR(S) : Raymond C. Kent et al.

It is certified that error appears in the above-identified patent and that said Letters Patent is hereby corrected as shown below:

Column 3, line 14, the word "plate" should read "paper".

In the Claims:

Claim 1, column 4, line 17, the word "plate" should read "paper".

Signed and Sealed this

Twenty-second Day of December, 1992

*Attest:*

DOUGLAS B. COMER

*Attesting Officer*

*Acting Commissioner of Patents and Trademarks*